US005822947A

United States Patent [19]

Tarrant

[11] Patent Number: 5,822,947

[45] Date of Patent: Oct. 20, 1998

[54] PLANK SUPPORT

[76] Inventor: Padraig Tarrant, 85 Brush Hill Rd., Kinnelon, N.J. 07405

[21] Appl. No.: 580,590

[22] Filed: Dec. 29, 1995

[51] Int. Cl.[6] ..... E04B 2/00

[52] U.S. Cl. ..... 52/781.3; 52/664; 52/660

[58] Field of Search ..... 52/781.3, 669, 52/666, 662, 660, 236.6, 236.7, 236.8, 236.9, 745.05, 745.13, 483.1; 182/690, 194, 228; 280/47.34, 79.1, 79.2

[56] References Cited

U.S. PATENT DOCUMENTS

| | | | |
|---|---|---|---|
| Re. 20,872 | 5/1938 | Focht . | |
| 1,842,621 | 1/1932 | Meyer | 52/666 X |
| 2,142,640 | 3/1939 | Focht . | |
| 2,591,654 | 4/1952 | Dean | 52/781.3 X |
| 2,620,752 | 12/1952 | Watter | 52/781.3 X |
| 3,551,001 | 12/1970 | Wilson | 280/47.34 |
| 3,596,422 | 8/1971 | Boettcher . | |
| 3,783,569 | 1/1974 | Roussin . | |
| 3,903,671 | 9/1975 | Cuin et al. . | |
| 3,995,403 | 12/1976 | Nickell | 52/664 X |
| 4,860,508 | 8/1989 | Jackson et al. . | |
| 5,005,846 | 4/1991 | Taylor | 280/47.34 X |
| 5,218,804 | 6/1993 | Campbell . | |
| 5,253,887 | 10/1993 | Marenger | 280/47.34 X |
| 5,476,282 | 12/1995 | Dahl | 280/47.34 X |
| 5,584,399 | 12/1996 | King | 280/47.34 X |

*Primary Examiner*—Creighton Smith
*Attorney, Agent, or Firm*—Richard C. Litman

[57] ABSTRACT

A plank and flange plate structure for providing additional bearing for the precast concrete planks on an underlying steel beam, the additional bearing being located on each side of the existing steel beam so as also to provide a transfer of the dead and live loads to the existing steel beam. Several embodiments include a square structure, made up of a pair of flange plates which rest on the steel beam, and a pair of plank plates supporting the precast concrete plank(s), and several structures located between adjacent steel beams, with two or three plank plates. Plank and flange plates may be secured together by welding, nut and bolt fasteners, riveting, or the parts may be formed (e.g., cast, molded, etc.) as a unitary structure.

6 Claims, 4 Drawing Sheets

PLANK SUPPORT

BACKGROUND OF THE INVENTION

1. Field of the Invention

The present invention relates to a method and apparatus for providing additional support to floor and ceiling planks or joists.

2. Description of Prior Art

The instant invention is directed to solving the prior art problem of reduced bearing area on the structural beams employed in the construction of precast concrete/steel structures. Basically, such construction involves the erection of a steel frame onto which precast concrete planks are laid, which span to form floors and roofs and finishes are applied to these surfaces. This form of relatively rapid construction has become very popular over the past few decades, especially since reduced time of construction results in substantial cost savings.

Unfortunately, this construction technique has led to unintended problems, typically during the phase of construction involving the placement of the precast concrete planks onto the steel frame—the second phase of construction. This phase did not demand a strong technical input from the engineer and/or architect and in some cases, a proper level of supervision was lacking. As a result and over time, the effects of improper installation coupled with, perhaps, movement due to foundation settlement, seasonal temperature changes and other factors, reduced bearing area on the structural steel beams has created a weakened and possibly dangerous structural condition.

The instant invention provides an uncomplicated solution in the form of increased bearing for the concrete planks and a transfer of live and dead loads onto the existing steel beam(s). The solution, in a preferred embodiment of the invention, takes the form of providing an additional two inch bearing for existing concrete planks on each side of the supporting, underlying steel beam.

The prior art reveals several systems and structures which can be used to provide additional support to floor or ceiling members. U.S. Pat. No. Re. 20,872 issued on Oct. 4, 1938 shows a floor support structure in which iron beams are laid side by side to form a bridge floor or deck. This floor or deck provides a foundation on which any type of pavement can be laid.

U.S. Pat. No. 2,142,640 issued on Mar. 12, 1937 teaches a steel flooring structure which uses channel beams and flanges to support a pavement floor. The floor structure is equipped with a anti-creep fin which prevents movement of the pavement or surface laid upon the floor structure.

U.S. Pat. No. 3,596,422 issued on Aug. 3, 1971 discloses a means for securing a flooring laid over a concrete base. The flooring is laid on a slidable sleeper beam to accommodate expansion and contraction of the floor and the sleeper during damp weather.

U.S. Pat. No. 3,783,569 issued on Jan. 8, 1974 shows a building construction for floors, ceilings, or roofs. The building construction is made of profiled beams secured together to form an I-beam. Each end of the I-beams is secured to other construction support structures, such as walls. An intermediate panel may be supported between adjacent I-beams, to conceal pipes, electrical wiring, or ducts that are installed between I-beams.

U.S. Pat. No. 3,903,671 issued on Sep. 9, 1975 teaches a lining system for building surfaces such as walls or ceilings. The lining system uses parallel spaced rails and adjustable connectors to support panels which provide a wall or ceiling lining within a building.

U.S. Pat. No. 4,860,508 issued on Aug. 29, 1989 discloses a flooring system having an upper and lower structure. The lower structure is made of a plurality of evenly space I-beams which are connect by styrofoam blocks. The upper structure is made of flooring planks which have long and short sides. The upper and lower structures are interlocked in a criss-cross pattern and secured by fasteners.

U.S. Pat. No. 5,218,804 issued on Jun. 15, 1993 shows a prefabricated wall panel for industrial, commercial, and residential use. The prefabricated walls can be used as load bearing walls to support horizontal joists and eliminate the need for additional columns or beams to support the joists.

None of the above inventions and patents, taken either singly or in combination, is seen to describe the instant invention as claimed.

SUMMARY OF THE INVENTION

This invention is a device to provide additional support to a floor and ceiling joist supported by a load bearing structure. The device extends the surface area around the point of contact between the joist or plank and the load bearing structure, such as a wall, beam, block, or column. The additional surface area will help maintain support to the joist or plank provided by the load bearing structure in situations where the joist or plank has moved off or nearly off of the load bearing structure.

Accordingly, it is a principal object of the invention to provide an increased surface area to support concrete planks used in commercial and residential buildings.

It is another object of the invention to provide additional support to any type of floor or ceiling joist used in a commercial and residential building.

Still another object of the invention is supply to a device that will provide support to floor and ceiling joists which have shifted from their original position due to seasonal temperature changes or from damp weather.

It is a further object of the invention to provide a device that will maintain support to the floor and ceiling joists during seismic activity that may shift the joists or planks away from the supporting structure.

Yet a further object of the invention is to provide a device which is quickly and easily installed during the construction of the building and that requires little or no supervision during the installation process.

Still a further object of the invention is to provide a device which may be quickly and easily added to an existing buildings to supplement the support provided by a wall, beam or column to a joist or plank.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a device which provides additional support to a joist, plank or beam. The device extends the surface area around the supporting structure, such as a block, wall, beam or column. The device has two or more plank plates which extend the surface upon which the joists or planks reside, thus to transfer live and dead loads to the underlying steel beam more effectively. The plank plates are suspended from two or more flange plates which traverse a portion of the load bearing structure. In the event that the plank or joist shifting position due to the settling of the structure, a sudden disruptive force, or temperature changes, the device will provide an increased amount of the support to the plank or joist from the load bearing structure to prevent it from sliding off the load bearing structure.

Figure 1:
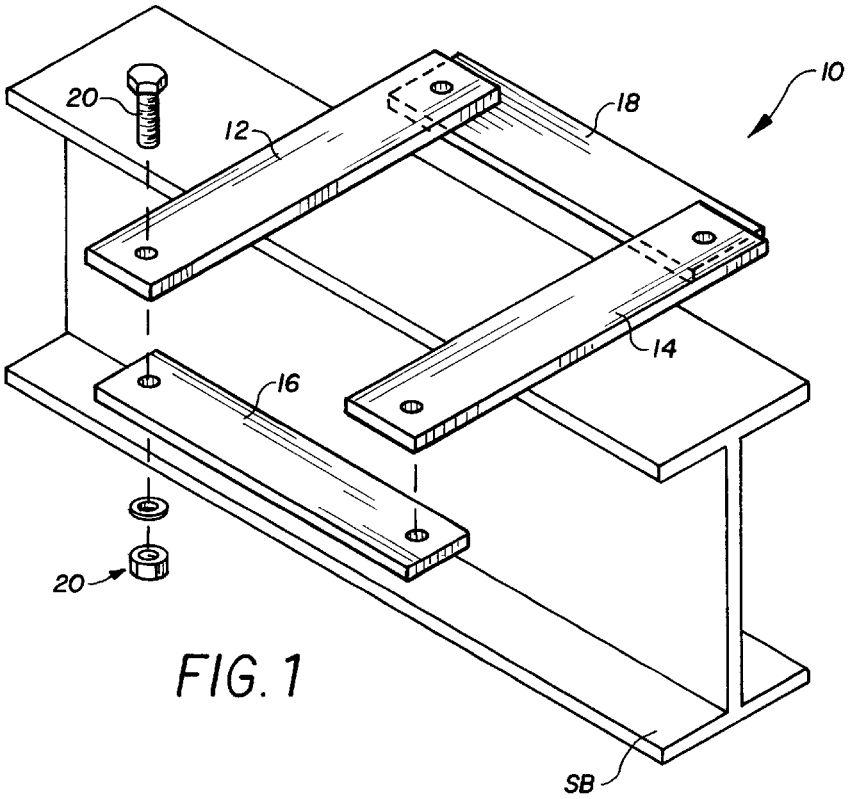
FIG. 1 is a partially exploded, detail perspective view of the plank support of the instant invention.
Figure 2:
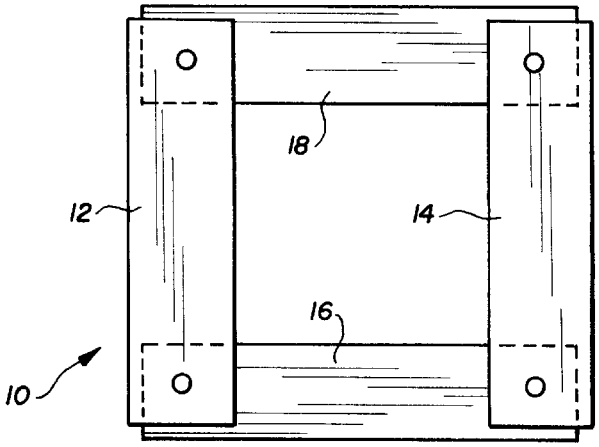
FIG. 2 is a top view of the plank support seen in FIG. 1.
Figure 3:
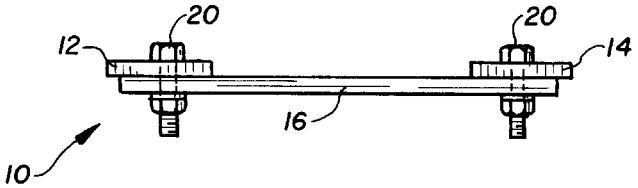
FIG. 3 is a side elevational view of the plank support as seen in FIG. 2.

In the first embodiment, shown in FIGS. 1 through 3, an existing steel beam SB is overlaid with a plank support system, each component 10 thereof being made up of a pair of flange plates 12, 14, joined at their ends to a complementary pair of plank plates 16, 18 by nut and bolt fasteners 20, one of which is indicated in FIG. 1. This system can be used, for example, to support a roof plank span, which would lie parallel to and between the flange plates 12, 14, the two plank plates 16, 18 supporting the roof plank span (not shown). In a preferred embodiment, the two plank plates 16, 18 provide an additional 2" or so bearing at each side of the existing steel beam SB, thereby providing a greatly strengthened existing structure and more effective transfer of dead and live loads to the steel beam SB.

Figure 4:
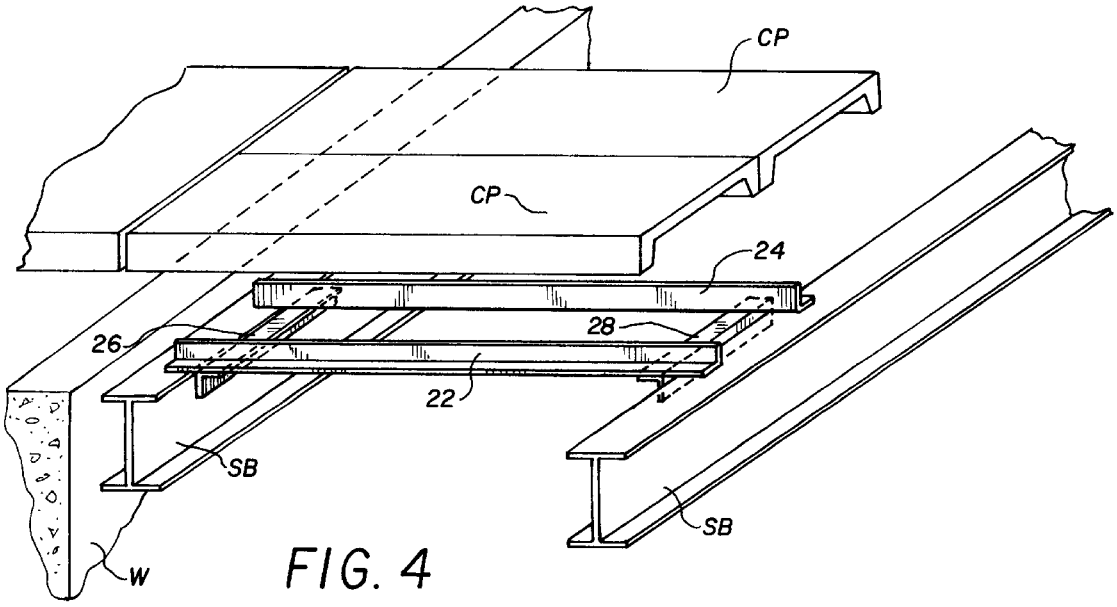
FIG. 4 is a partially exploded, perspective view of the plank support with the plank plates inset on the flange plates.
Figure 5:
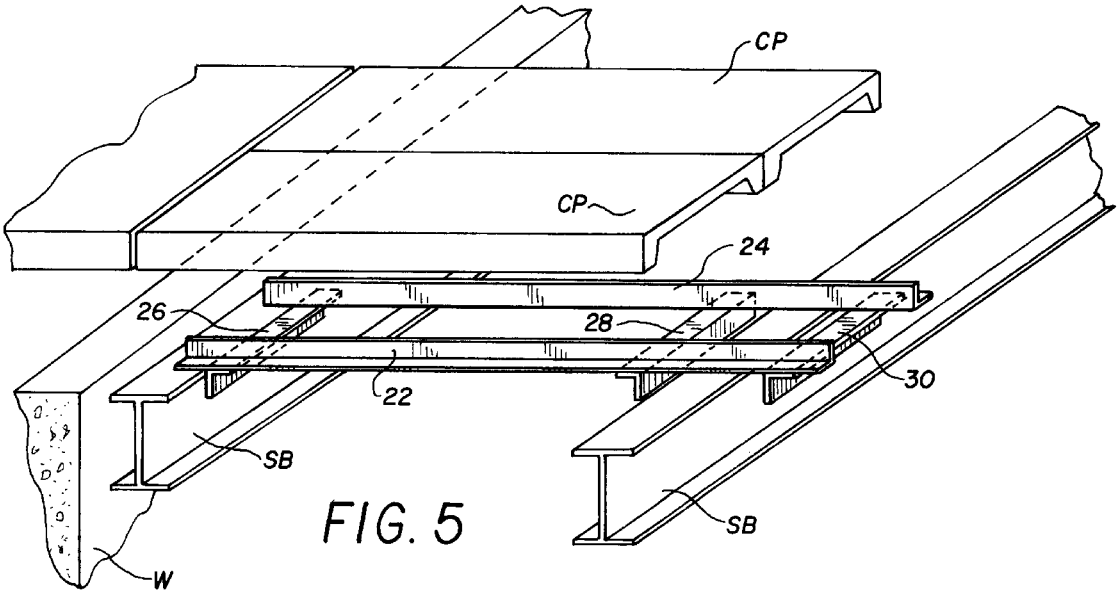
FIG. 5 is a partially exploded, perspective view of the plank support with three plank plates.

With reference now to FIGS. 4 and 5, two additional embodiments of the invention are shown, the components of which may be fabricated from common angle iron which, of course, has a vertical half portion and a complementary horizontal half portion. As seen in FIG. 5, the flange plates 22, 24 are of extended length to span a pair of adjacent steel beams SB, SB, with the shorter plank plates 26, 28 supporting concrete plates CP, CP. Note that in this embodiment, the beams SB, SB run parallel an existing wall W. The embodiment in FIG. 5 is conceptually the same as that shown in FIG. 4, except that an additional plate plank 30 is provided, for increased load transfer to the right hand steel beam SB.

Figure 6:
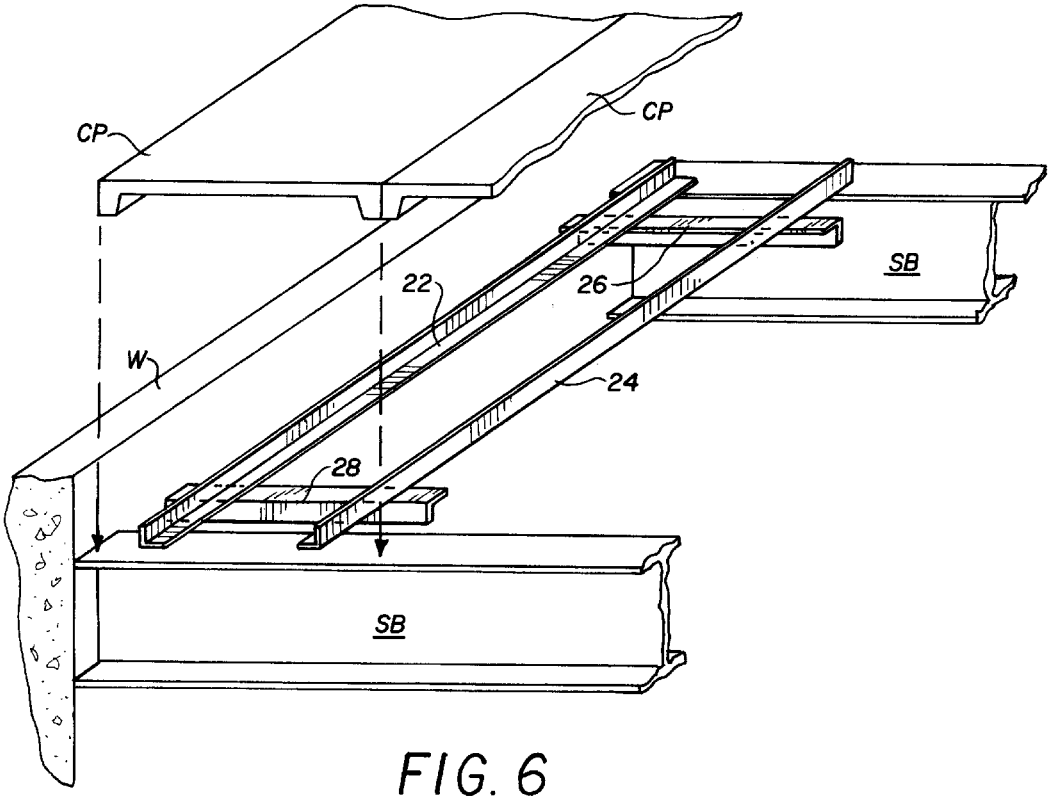
FIG. 6 is a partially exploded, perspective view of the plank support with two inset plank plates and inset flange plates.
Figure 7:
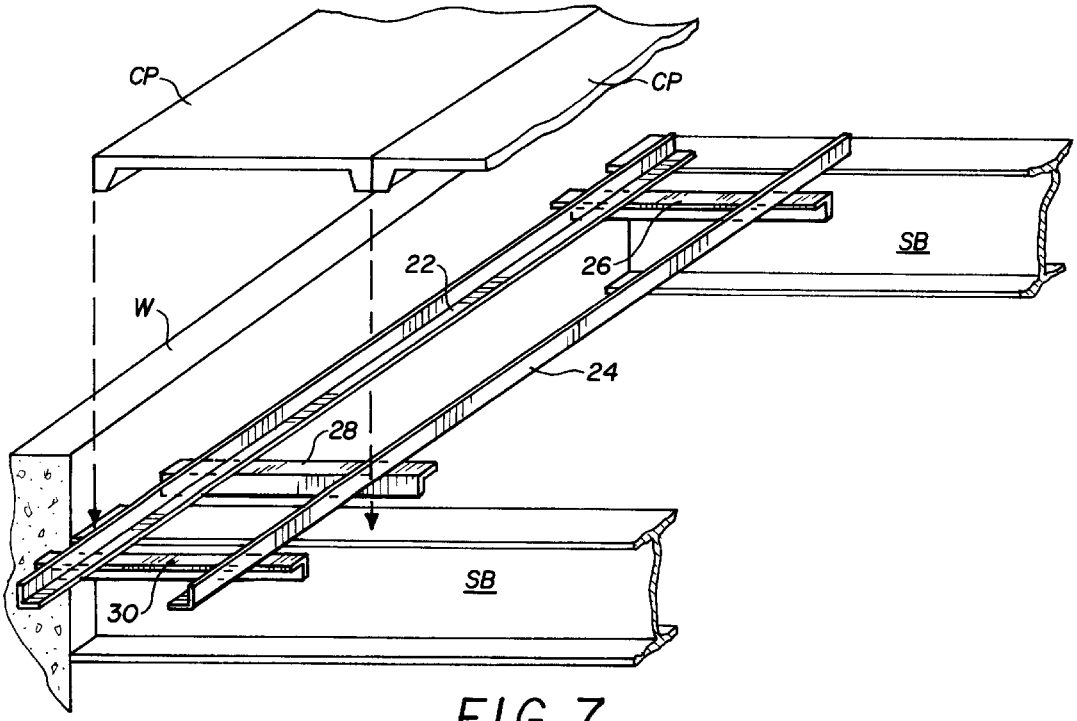
FIG. 7 is a partially exploded, perspective view of the plank support with the flange plate inset on three plank plates.

Turning now to FIGS. 6 and 7, the two further embodiments of the invention disclosed are similar to those illustrated in FIGS. 4 and 5; it is the existing structure to which the invention is applied that is somewhat different. Here, the steel beams SB run at right angles to an existing wall W, rather than parallel therewith, as is the case shown in FIGS. 4 and 5. Thus, the concrete planks CP run parallel the wall W rather than at right angles thereto, as in the embodiments shown in FIGS. 4 and 5. In either event, the invention is effective in accomplishing the objective of providing additional bearing support and enhancing the integrity of the existing structure.

Figure 8:
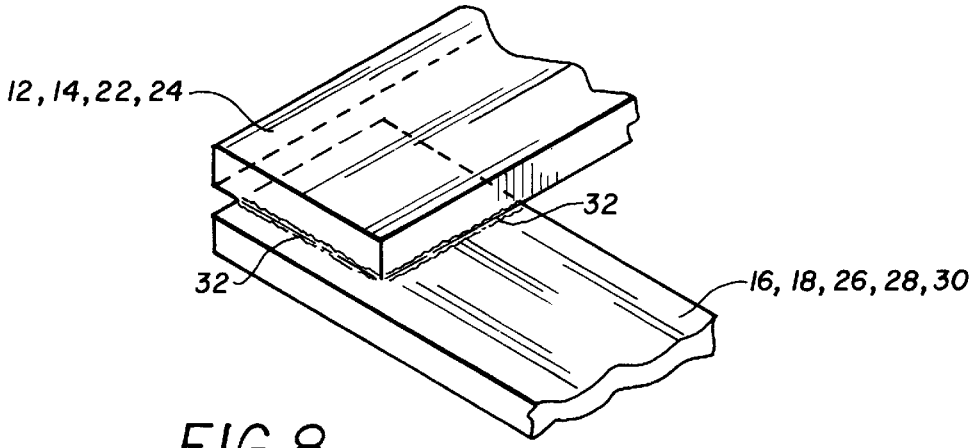
FIG. 8 is a detail perspective view of a welded plank and flange plate.
Figure 9:
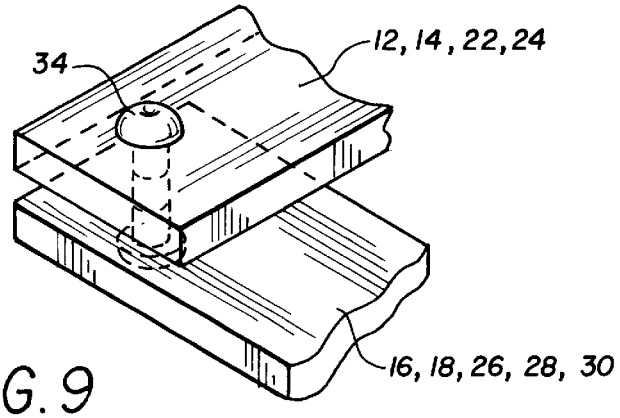
FIG. 9 is a detail perspective view of a riveted plank and flange plate.
Figure 10:
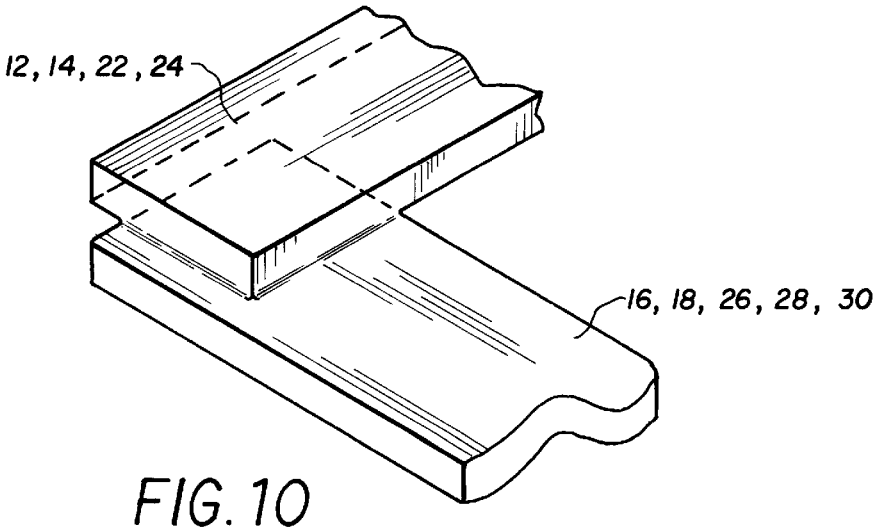
FIG. 10 is a detail perspective view of a plank and flange plate formed (e.g., cast, molded, etc.) as a single unit.

In the case of employing angle iron to fabricate the invention as shown in FIGS. 4 through 7, preferably the plank and flange components will be welded together, although other suitable interconnection of components could be used. Welding 32, for example, is indicated in FIG. 8 for interconnecting flange and plank components. In FIG. 9, riveting 34 is illustrated. As can be appreciated from FIG. 10, the plank and flange components could be formed of one-piece, unitary construction; such might be suitable for at least the embodiment of the invention illustrated in FIGS. 1–3.

It is to be understood that the present invention is not limited to the embodiments described above, but encompass any and all embodiments within the scope of the following claims.

I claim:

1. A plank support system comprising, in combination:

a load bearing beam; and an apparatus that provides additional support to said load bearing beam, said apparatus including:

a first flange plate and a second flange plate, each said flange plate having a first and a second end and a lower surface;

a first plank plate and a second plank plate, each said plank plate having a first end and a second end and an upper surface;

wherein each said flange plate and each said plank plate are formed from angle iron;

means for securing each said plank plate to each said flange plate, wherein said lower surface of said first flange plate at said first end is secured to said upper surface of said first plank plate at said first end, said lower surface of said first flange plate at said second end is secured to the upper surface of said second plank plate at said first end, said lower surface of said second flange plate at said first end is secured to said upper surface of said first plank plate at said second end, and said lower surface of said second flange plate at said second end is secured to upper surface of said second plank plate at said second end; whereby said apparatus is placed on said load bearing beam such that each said flange plate mounts perpendicularly to said load bearing beam thereby aligning each said plank plate adjacent and parallel to said load bearing beam that provides additional support to planks placed thereon.

2. The plank support system according to claim 1 wherein said apparatus further includes a second load bearing beam spaced from and parallel to said load bearing beam, and a third plank plate having a first end, a second end and an upper surface, wherein each said flange plate is extended to engage said second load bearing beam, said upper surface of said third plank plate at said first end secured to said lower surface of said first flange plate and said upper surface of said third plank plate at said second end secured to said lower surface of said second flange plates, said third plank plate aligning adjacent and parallel to said second load bearing beam.

3. The plank support system according to claim 1, wherein said means for securing said plank plates to said flange plates comprise welding at each said end.

4. The plank support system according to claim 1, wherein said means for securing said plank plates to said flange plates comprise riveting at each said end.

5. The plank support system according to claim 1, wherein said means for securing said plank plates to said flange plates comprise forming the plank plates and flange plates as a single solid unit.

6. The plank support system according to claim 1, wherein said means for securing said plank plates to said flange plates comprise a bolt and nut fastener, the bolt passing through mating holes in each said flange plates and each said plank plates.

* * * * *